US006912369B2

(12) United States Patent
Saito et al.

(10) Patent No.: US 6,912,369 B2
(45) Date of Patent: Jun. 28, 2005

(54) IMAGE FORMING APPARATUS

(75) Inventors: Seiji Saito, Shizuoka (JP); Tatsuya Kobayashi, Shizuoka (JP); Masaru Shimura, Shizuoka (JP); Koichi Suzuki, Shizuoka (JP); Takamitsu Soda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/667,351

(22) Filed: Sep. 23, 2003

(65) Prior Publication Data

US 2004/0126149 A1 Jul. 1, 2004

(30) Foreign Application Priority Data

Sep. 24, 2002 (JP) ..... 2002-278173

(51) Int. Cl.[7] ..... G03G 15/16
(52) U.S. Cl. ..... 399/297; 399/99; 399/101
(58) Field of Search ..... 399/98, 99, 101, 399/66, 297, 302

(56) References Cited

U.S. PATENT DOCUMENTS 5,173,847 A 12/1992 Suzuki ..... 363/21
5,250,994 A 10/1993 Ito et al.
5,567,997 A 10/1996 Suzuki et al. ..... 307/127
5,740,502 A 4/1998 Kobayashi et al. ..... 399/128
5,742,873 A 4/1998 Kubo et al. ..... 399/98
6,049,681 A * 4/2000 Shiozawa et al. ..... 399/46
6,226,467 B1 5/2001 Nakagawa et al. ..... 399/55
6,311,031 B1 * 10/2001 Hirano ..... 399/101
6,603,932 B2 8/2003 Katayanagi et al. ..... 399/21
6,615,015 B2 * 9/2003 Nakazawa et al. ..... 399/302

FOREIGN PATENT DOCUMENTS

JP 2002-116640 4/2002

* cited by examiner

*Primary Examiner*—Hoang Ngo
(74) *Attorney, Agent, or Firm*—Fitzpatrick, Cella, Harper & Scinto

(57) ABSTRACT

The invention provides an image forming apparatus including an image bearing member, an intermediate transferring member for receiving a transfer of a toner image from the image bearing member, a cleaning unit which cleans the toner image on the intermediate transferring member, a first mode for transferring a toner image on the intermediate transferring member onto a transfer material, and a second mode for cleaning the toner image without transfer to the transfer material. It is thus possible to prevent image failures resulting when the intermediate transferring member is started to be used from a new state or when the image forming apparatus is started to be used after a prolonged pause.

7 Claims, 4 Drawing Sheets

IMAGE FORMING APPARATUS

BACKGROUND OF THE INVENTION

1. Field of the Invention

The present invention relates to an image forming apparatus such as a printer, a copying apparatus or a facsimile, and more particularly to an image forming apparatus utilizing an intermediate transferring member.

2. Related Background Art

As an image forming apparatus of electrophotographic process, there is already commercialized a multi-color image forming apparatus of transferring a developer image (toner image), formed on a first image bearing member such as single or plural photosensitive drums, onto an intermediate transferring member constituting a second image bearing member thereby forming a toner image of plural colors on the intermediate transferring member, and transferring the toner image of the plural colors on the intermediate transferring member onto a transfer material constituting a third image bearing member thereby forming a multi-color image.

In such known multi-color image forming apparatus, the intermediate transferring member is in contact, at a primary transfer portion, with the photosensitive drum, and a toner image formed on the photosensitive drum is once transferred (primary transfer) onto the intermediate transferring member, and is then transferred (secondary transfer), at a secondary transfer portion, from the intermediate transferring member onto the transfer material. Thereafter the transfer material, bearing the transferred toner image, arrives at a fixing apparatus and is subjected to heat and pressure therein to obtain a permanently fixed image. On the other hand, toner remaining on the intermediate transferring member after the secondary transfer is cleaned from the intermediate transferring member.

In the above-described multi-color image forming apparatus of intermediate transferring type, there is obtained an advantage that limitation is reduced in conveying the transfer material, since the toner images formed on the intermediate transferring member are collectively transferred to the transfer material.

On the other hand, since the transfer is executed plural times such as the primary transfer and the secondary transfer, there is encountered a drawback that the density becomes extremely low unless a transfer efficiency is improved, for example, by employing toner with an excellent transfer efficiency. Also there is encountered a drawback that a transferring property fluctuates in time or locally, thereby resulting in an instability of the image quality, unless a surface of the intermediate transferring member, bearing the toner image, is uniform and stable in time.

SUMMARY OF THE INVENTION

An object of the present invention is to prevent an image defect that appears when an intermediate transferring member is started to be used from a new state, or when an intermediate transferring member is started to be used after a prolonged pause. More specifically, it is to bring a surface of the intermediate transferring member to a state after an image forming operation, thereby obtaining a constantly same image output regardless of the state of use of the image forming apparatus.

Another object of the present invention is to provide an image forming apparatus including an image bearing member, an intermediate transferring member for receiving a transfer of a toner image from the image bearing member, and cleaning means which cleans the toner image on the intermediate transferring member, wherein the apparatus has a first mode of transferring a toner image on the intermediate transferring member onto a transfer material, and a second mode of forming a toner image in an entire area capable of image formation on the intermediate transferring member and cleaning such toner image without transferring such toner image onto the transfer material.

Still other objects of the present invention will become fully apparent from the following description.

DESCRIPTION OF THE PREFERRED EMBODIMENTS

In the following, the image forming apparatus of the present invention will be explained in detail, with reference to the accompanying drawings.

Embodiment 1

Figure 1:
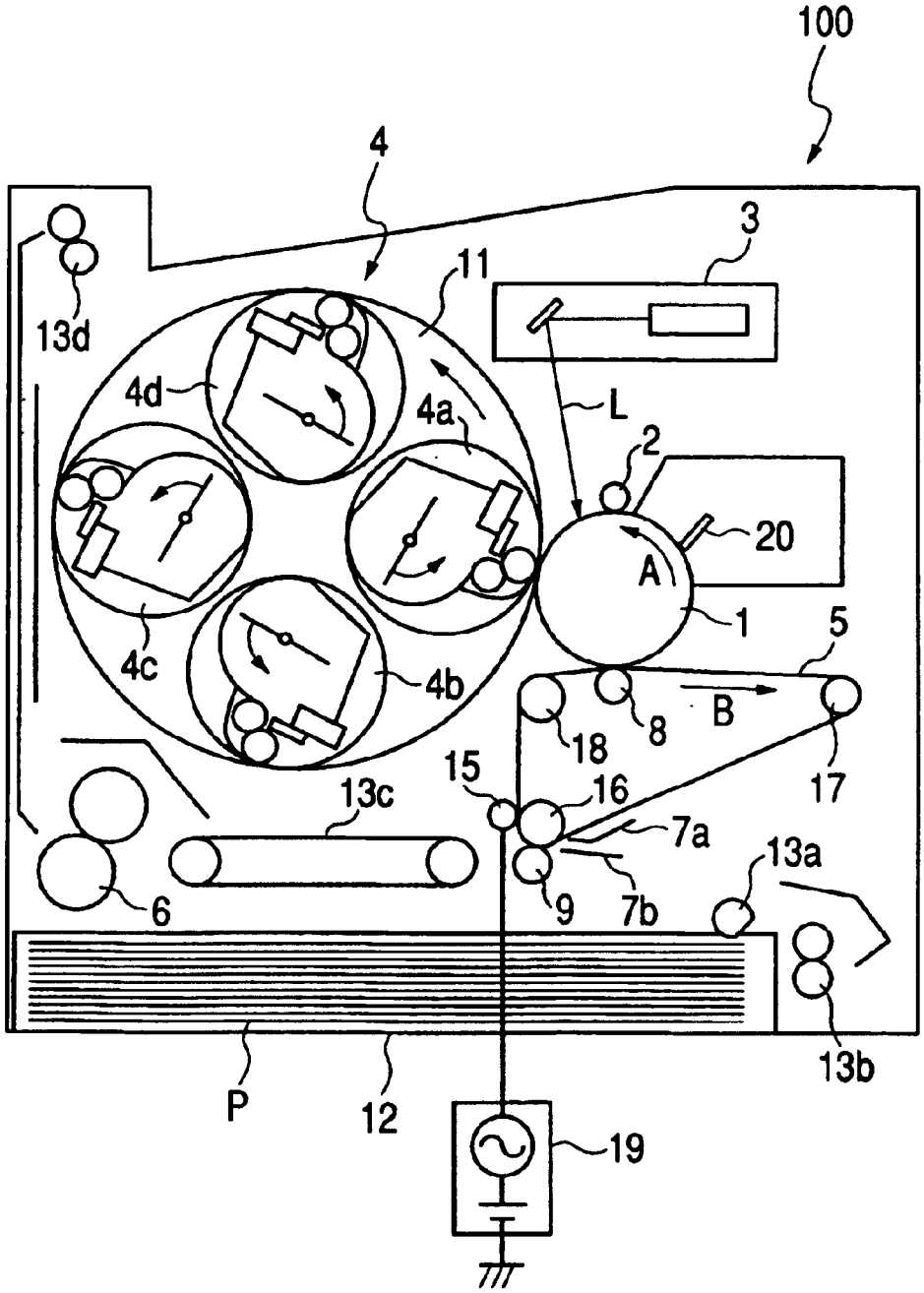
FIG. 1 is a schematic view showing the configuration of an embodiment of an image forming apparatus of the present invention.

FIG. 1 schematically shows a configuration of an embodiment of an image forming apparatus of the present invention. In the present embodiment, an image forming apparatus 100 is a color image forming apparatus of electrophotographic process, employing an intermediate transfer method, in which toner images of respective colors, formed according to image information separated into color components of yellow, magenta, cyan and black, are primary transferred to and superposed on an intermediate transferring member (intermediate transferring belt) and then secondary transferred onto a transfer material. At first there will be outlined the entire configuration of the image forming apparatus 100 of the present embodiment, and then there will be explained operations (modes) thereof.

<Outline of Configuration>

The configuration of the image forming apparatus of the present embodiment, employing an intermediate transferring belt 5, will be briefly explained with reference to FIG. 1.

An intermediate transfer belt 5 was formed by polyvinylidene fluoride (PVDF) into an endless film of a thickness of about 100 $\mu$m. It is also possible to employ a resinous belt (subjected to an adjustment of an electrical resistance if necessary) of polyimide (PI), nylon, polyethylene terephthalate (PET) or polycarbonate. An intermediate transferring belt 5 is supported by an opposed roller 16 (a roller opposed to a secondary transfer roller in a secondary transfer portion inside of the intermediate transferring belt 5), a driving roller 17, a tension roller 18, etc.

On a photosensitive drum 1, a latent image is formed by a primary charging by charging means 2 and an exposure 3 by an exposure apparatus, and such latent image is developed into a visible image, namely a toner image, by a developing apparatus 4. On the other hand, in a position opposed to the photosensitive drum 1 across the intermediate transferring belt 5, there is provided a primary transfer roller 8 formed by covering a metal shaft with foamed sponge, as primary transfer means which transfers the toner image, formed on the photosensitive drum 1, onto the intermediate transferring belt 5. The primary transfer roller 8 is pressurized with a pressure of 800 gf, and is given a positive primary transfer bias at a transfer operation.

In a position opposed to the opposed roller 16 across the intermediate transferring belt 5, there is provided secondary transfer means such as a secondary transfer roller 9, which transfers the toner image from the intermediate transferring belt 5 to a transfer material P. The secondary transfer roller 9 is given a secondary transfer bias at a secondary transfer operation.

Also in a position downstream of the secondary transfer roller and opposed to the opposed roller 16 across the intermediate transferring belt 5, there is provided an intermediate transfer member cleaningless roller 15 (hereinafter called "ICL roller") constituting a part of means which cleans a transfer residual toner on the intermediate transferring belt 5.

The toner remaining on intermediate transferring belt 5, for example, the secondary transfer residual toner remaining thereon without being transferred onto the transfer material P, is charged positively by a bias voltage formed by superposing an AC voltage with a positive DC voltage, supplied from an intermediate transfer member cleaningless roller power supply (hereinafter called "ICL power supply"). The ICL roller 15 is provided with a mechanism (not shown) for contacting with and separating from the intermediate transferring belt 5, and is contacted therewith only in a charging operation.

Thus, positively charged secondary transfer residual toner, on the intermediate transferring belt 5, is electrostatically transferred, at the primary transferring portion where the primary transfer roller 8 is provided, onto the photosensitive drum 1 under an application of a bias of a polarity the same as that of the ordinary primary transfer bias, whereby the secondary transfer residual toner is eliminated from the intermediate transferring belt 5. Thus, the ICL roller 15, the primary transfer roller 8, the photosensitive drum 1 and the power source for the primary transfer bias constitute cleaning means.

Also for increasing the number of prints in a continuous printing operation, there is executed a so-called cleaning operation simultaneous with transfer in which a first-color image of a next image is transferred from the photosensitive drum 1 onto the intermediate transferring belt 5 at the transfer of the residual toner from the intermediate transfer belt 5 onto the photosensitive drum 1, because a same bias voltage can be utilized for the primary transfer operation and the cleaning operation.

<First Mode>

In the following, there will be explained an operation (first mode) of forming an image on the transfer material. The image forming apparatus 100 is provided with a drum-shaped electrophotographic photosensitive member constituting an image bearing member, namely the photosensitive drum 1. The photosensitive drum 1 is driven in a direction A by drive means (not shown), and is uniformly charged by a primary charger 2 constituting charging means.

Then an exposure apparatus 3 irradiates the photosensitive drum 1 with a laser beam L according to image information of yellow color thereby forming a latent image on the photosensitive drum 1.

In the present embodiment, a rotary developing apparatus 4 is provided, opposed to the photosensitive drum 1. The rotary developing apparatus 4 is provided with a rotary support member 11 supporting a yellow developing apparatus 4*a*, a magenta developing apparatus 4*b*, a cyan developing apparatus 4*c*, and a black developing apparatus 4*d*. The developing apparatuses contain toners of respective colors, and the toner triboelectrically charged negatively by a sleeve of the developing apparatus develops the electrostatic latent image in a following manner.

As the photosensitive drum 1 bearing the latent image further advances in a direction A, the rotary support member 11 is so rotated that the yellow developing apparatus 11*a* is opposed to the photosensitive drum 1. Thus selected yellow developing apparatus 4*a* renders the latent image, formed on the photosensitive drum 1 according to the yellow image information, visible as a toner image.

In the present embodiment, in a position downstream of the developing position in the rotating direction A of the photosensitive drum 1, an endless intermediate transferring belt 5 is supported by plural rollers and is moved (rotated) in a direction B, at a peripheral speed substantially the same as that of the photosensitive drum 1.

In a position opposed to the photosensitive drum 1 across the intermediate transferring belt 5, a primary transfer roller 8 is provided as primary transfer means, thus constituting a primary transfer nip portion. Thus, along the rotation of the photosensitive drum 1 and the intermediate transferring belt 5 and under an application of a primary transfer bias to the primary transfer roller 8, the toner image formed and borne on the photosensitive drum 1 is primary transferred onto an external periphery of the intermediate transferring belt 5.

The above-explained steps are repeated also for magenta, cyan and black colors in a similar manner to obtain, on the intermediate transferring belt 5, toner images of plural colors, for example, four toner images of yellow, magenta, cyan and black colors in case of a full-color image, in superposed manner.

Then a transfer material P is conveyed at a predetermined timing by feed rollers 13*a*, 13*b* from a sheet cassette 12, then guided by guides 7*a*, 7*b* and supplied to a secondary transfer nip portion in which the secondary transfer roller 9 and the opposed roller 16 are mutually opposed. At the same time, a secondary transfer bias is supplied to the secondary transfer roller 9, whereby the superposed 4-color toner images are transferred from the intermediate transferring belt 5 onto the transfer material p.

The transfer material P bearing the transferred toner image is further conveyed by conveying means 13*c* to a fixing apparatus 6, in which the toner image on the transfer material P is fused and fixed thereto. Thereafter the transfer material P is discharged from the apparatus, for example, by conveying rollers 13*d*, etc. A color image is obtained in this manner. Also secondary transfer residual toner, remaining on the intermediate transferring belt 5 without being transferred to the transfer material P, is eliminated by cleaning means for the intermediate transferring belt.

As the cleaning means for the intermediate transferring belt 5 of the present embodiment, the ICL power source 19 supplies the ICL roller 15 with a bias voltage formed by superposing a sinusoidal wave of a frequency of 2 kHz and an amplitude of 2 kV with a DC voltage of 1 kV. Thus, the secondary transfer residual toner is given a charge, and is charged in a positive polarity which is opposite to the polarity in the developing operation. The secondary transfer residual toner, thus positively charged, is transferred to the photosensitive drum 1 at the primary transfer in a next image formation, thereby being eliminated from the intermediate transferring belt 5. Thus, the cleaning of the photosensitive drum 1 is achieved by an electric field formed between the intermediate transferring belt 5 and the photosensitive drum 1. Then, the secondary transfer residual toner, transferred onto the photosensitive drum 1, is cleaned from the photosensitive drum 1 by a cleaning blade 20 constituting cleaning means for the photosensitive drum 1.

<Case of New Intermediate Transferring Belt 5>

The above-described first mode provided a satisfactory image output without any problem immediately after an image output test, etc. at a manufacturing factory.

However, following image defects were found immediately after a new intermediate transferring belt 5 was incorporated. For example, in case of outputting a halftone image after an output of a character image immediately after a replacement with a new intermediate transferring belt 5, a negative ghost image of the previously output character image appeared on the later output halftone image. Experimental investigation of the phenomenon by the present inventors clarified that a toner deposition on the intermediate transferring belt 5 generated a hysteresis of toner deposition (history record of toner attachment), increasing the transfer property thereafter.

This mechanism is estimated as follows. In case the toner is once deposited on the intermediate transferring belt 5, a part of an external additive of the toner remains on the intermediate transferring belt 5 even after a cleaning thereof. Such external additive on the intermediate transferring belt 5 is considered to contribute to an improvement in the transfer property. Particularly in a secondary transfer, the external additive remaining on the intermediate transferring belt 5 exhibits a spacer effect to the toner transferred thereon, thus facilitating the toner to be released from the intermediate transferring belt 5. Therefore, in case the toner is deposited even once on the intermediate transferring belt 5, the transfer property is improved for a certain period thereafter while the transfer property remains unimproved in case of no toner deposition even once, thereby generating a negative ghost image.

In an image forming apparatus for electrically cleaning the toner as in the present embodiment, a main toner body (designating the toner components other than the external additive) can be very efficiently cleaned while the external additive of the toner, being less movable electrically, remains more efficiently. This tendency is further enhanced by a small particle size of the external additive and by that, in case of charging the toner with the ICL roller 15, the main toner body is easily charged but the external additive is hardly charged. Also intermediate transfer member cleaning means utilizing a cleaning blade is also commonly utilized, but even in the cleaning means utilizing such cleaning blade, a similar phenomenon may appear because the external additive, because of the difference in particle size, tends to pass through the gap between the cleaning blade and the intermediate transferring member. However, the amount of the external additive remaining on the intermediate transferring member is estimated to be less than that in case of the cleaning means utilizing the electric field.

This phenomenon is considered as a drawback in generating a negative ghost image when the intermediate transferring belt 5 is substantially new, but can also be considered as a favorable state in exhibiting a high transfer efficiency after the external additive is uniformly deposited on the intermediate transferring belt 5.

<After Prolonged Pause>

In case the intermediate transferring belt 5 is not new but is let to stand for a prolonged time, there may result a phenomenon similar to that in the aforementioned case of <new intermediate transferring belt 5>. The phenomenon is similar to the negative ghost, but is cause by a cause somewhat different from that of the aforementioned phenomenon. This is assumed to be caused by a deterioration of the toner releasing property of the intermediate transferring belt 5, for example, by a deposition of ozone products or moisture in the air onto the intermediate transferring belt 5. In case the toner is once deposited onto the intermediate transferring belt 5 in such state, the toner deposited on the intermediate transferring belt 5 wipes off the unnecessary moisture and the repeated deposition of the external additive exhibits the aforementioned spacer effect. These phenomena are considered to improve the toner releasing property. Thus the transfer efficiency is improved locally in the portion of the toner deposition, as in the aforementioned case of <new intermediate transferring belt 5>.

In the present embodiment, separate from the aforementioned first mode, there is executed a second mode to be explained in the following, thereby solving the drawbacks resulting in case of <new intermediate transferring belt 5> and <after prolonged pause>.

<Second Mode>

In a so-called pre-rotation operation at the start of power supply, there were executed operations similar to the cleaning step for the intermediate transferring belt 5, by forming a toner image (yellow toner image which is a first color image in this case) in an area at least equal to a printable area of the intermediate transferring belt 5 (one turn of the intermediate transferring belt 5 in this case), then applying a bias to the ICL roller 15 to inversely charge the yellow toner image formed on the intermediate transferring belt 5 without executing a secondary transfer step, and returning the toner onto the photosensitive drum 1. Thus, the <second mode> is executed both in case the intermediate transferring belt 5 is new and after a prolonged pause. In the above-described step, the effect was confirmed by changing the proportion of toner to be formed. In addition to a solid image with a proportion of 100%, halftone images of predetermined proportions were formed for one turn of the intermediate transferring belt 5. After the output of a halftone image of a predetermined proportion, a character image was output, and then a halftone image was output to confirm whether a negative ghost image was output. Results of evaluation are shown in the following. In a rating A, no generation of a negative ghost image was observed. In a rating B, a negative ghost image was observed only very slightly, but was of such a slight level as to be hidden in other image unevenness. A rating C indicates a level not much different from a state not executing the <second mode>.

TABLE 1

Results of Experiment 1

| Image Ratio (%) | Secondary Transfer Efficiency |
|---|---|
| 100 | A |
| 90 | A |
| 80 | A |

TABLE 1-continued

| Results of Experiment 1 | |
|---|---|
| Image Ratio (%) | Secondary Transfer Efficiency |
| 70 | A |
| 60 | A |
| 50 | A |
| 40 | A |
| 30 | B |
| 20 | C |
| 10 | C |

From the foregoing results, by forming an image of a ratio of 30% or higher on the intermediate transferring belt 5 and then executing a predetermined cleaning step, a ghost image encountered in case of <new intermediate transferring belt 5> was scarcely found, and, also even <after prolonged pause>, an image such as a negative ghost was scarcely recognized presumably because the surface state of the intermediate transferring belt 5 can be returned to an appropriate state.

Also in the present experiment, it was confirmed that a cleaning failure was generated on the photosensitive drum 1 when the image ratio increased. At an image ratio equal to or higher than 90%, an amount of the toner recovered on the photosensitive drum 1 increases and the toner passes through under the cleaning blade 20 because of the recovered toner amount becomes larger than that in the ordinary state. This phenomenon can be coped with by increasing an intrusion amount of the cleaning blade 20 or increasing a setting angle thereof, but may also result in a drawback such as a winding-up of the cleaning blade.

In the present embodiment, therefore, the image ratio can be within a range of 30%≦image ratio≦80% for providing a maximum effect and not causing other drawbacks.

Also the configuration of the present embodiment does not involve an unnecessary use of the transfer material P, since the toner image formed on the intermediate transferring belt 5 is cleaned without the secondary transfer to the transfer material P in an operation other than an image forming operation.

In the present embodiment, the effect was confirmed with the yellow toner which was the first color, but a similar effect could be obtained also with magenta, cyan or black toner. However the use of the yellow toner is preferred because the yellow toner provides a lesser detrimental influence on the image in case of an eventual cleaning failure.

In the present embodiment, a sufficient effect could be confirmed by a cleaning of a turn of the intermediate transferring belt 5. As explained in the foregoing, it was rendered possible to prevent an image failure resulting from a local variation of the secondary transfer efficiency of the intermediate transferring belt 5 in case it is new or after a prolonged pause.

Figure 2:
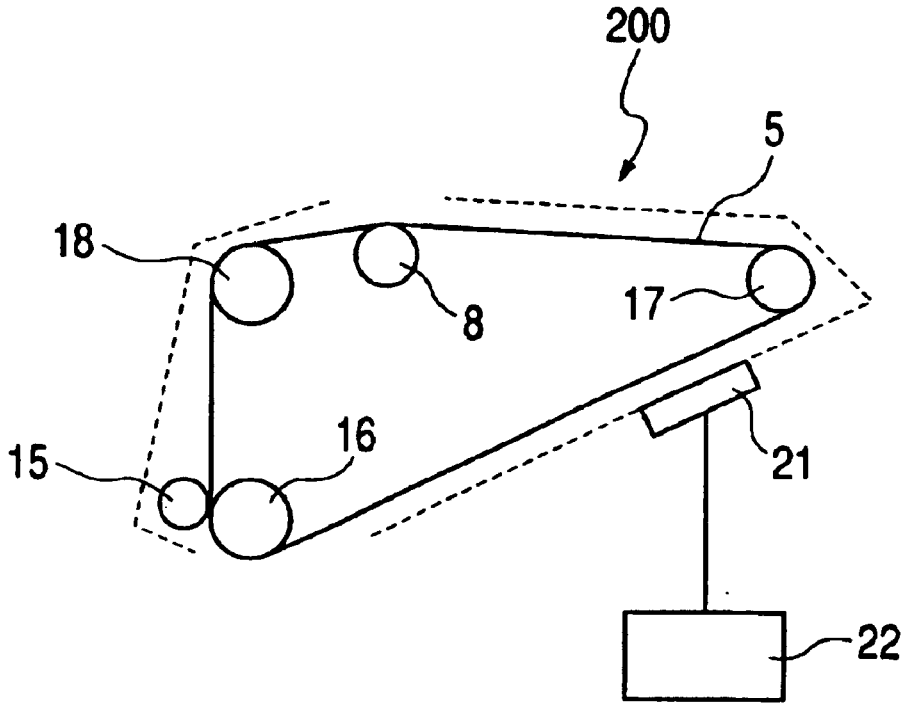
FIG. 2 is a schematic view showing the configuration of another embodiment of the image forming apparatus of the present invention.

The image forming apparatus of the present embodiment is a full-color image forming apparatus, but a similar effect could be obtained also in a monochromatic image forming apparatus having similar components. FIG. 2 shows an example of such apparatus, in which components of like functions as those in FIG. 2 are represented by like numbers.

Embodiment 2

In the present embodiment, a secondary transfer failure generated with a new intermediate transferring belt 5 is resolved by executing the <second mode> as in the embodiment 1 by detecting a new state of the intermediate transferring belt 5.

Figure 3:
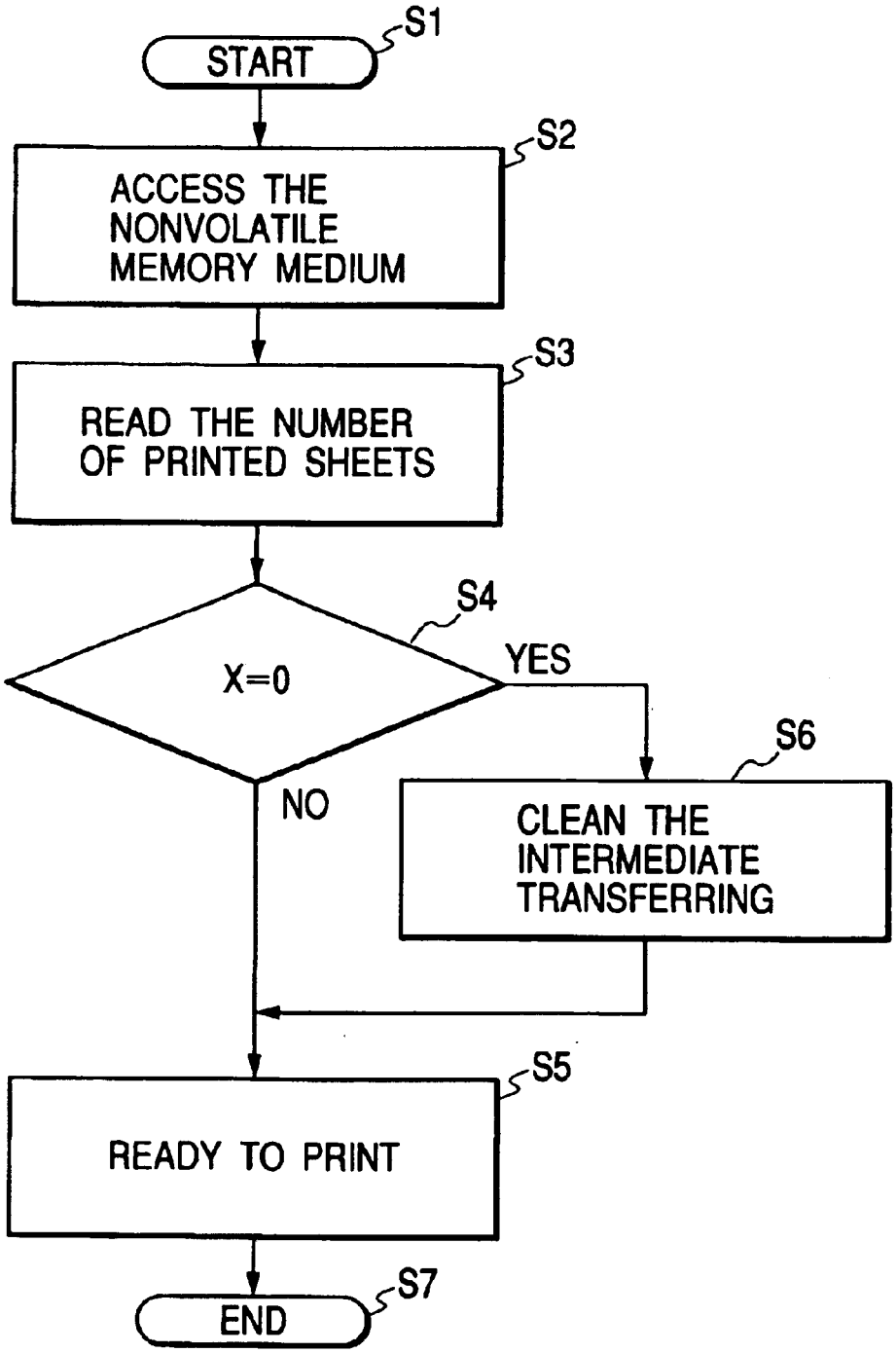
FIG. 3 is a schematic view showing an intermediate transferring unit in a second embodiment of the present invention.

At first reference is made to FIG. 3 for explaining a configuration of an intermediate transfer unit 200 including the intermediate transferring belt 5 and a method for detecting an initial state of the intermediate transferring belt 5.

The intermediate transferring belt 5 is supported by an opposed roller 16, a driving roller 17 and a tension roller 18, and also surrounds a primary transfer roller 8, and an ICL roller 15 is provided in a position opposed to the opposed roller 16 across the intermediate transferring belt 5.

The intermediate transfer unit 200 is an integral cartridge replaceable by the life time of the intermediate transferring belt 5. The intermediate transfer unit 200 is provided with a non-volatile memory medium 21 capable of storing a use history (for example, a print number), and capable of data communication with a main body of the image forming apparatus either in a non-contact or contact method. The non-volatile memory medium 21 is capable of understanding a state of use of the intermediate transferring belt 5 through a communication with a CPU 22 of the main body of the image forming apparatus.

In the following there will be explained an operation of the present invention, executed through a detection of the new state of the intermediate transferring belt 5.

Figure 4:
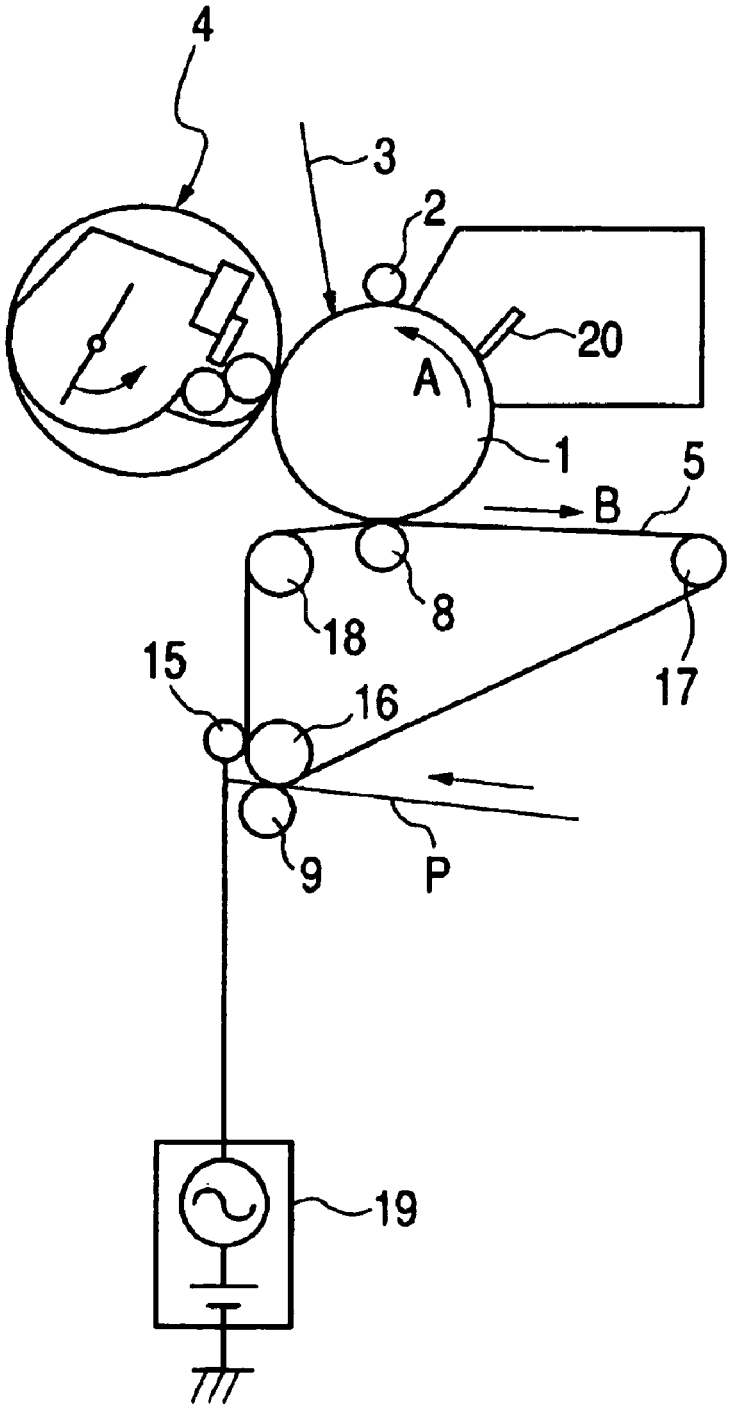
FIG. 4 is a flow chart showing the second embodiment of the present invention.

FIG. 4 shows a flow chart of a sequence of operations executed in the present embodiment.

When a power supply is turned on (S1), the CPU 22 of the main body of the image forming apparatus accesses the non-volatile memory medium 21 (S2), thereby reading a print number (X) (S3). There is discriminated whether X is 0 (S4), and, in case X≠0, an ordinary print ready state is reached (S5), whereupon the operation is terminated (S7). In case X=0, indicating that the intermediate transferring belt 5 is new, an aforementioned image formation is executing in at least a printable area of the intermediate transferring belt 5 and a cleaning step for the intermediate transferring belt 5 (<second mode>) is executed (S6). Thereafter, the print ready state is reached (S6), whereupon the operation is terminated (S7).

An experiment similar to that in embodiment 1 in the above-explained configuration provided the following results.

TABLE 2

| Results of Experiment 2 | |
|---|---|
| Image Ratio (%) | Secondary Transfer Efficiency |
| 100 | A |
| 90 | A |
| 80 | A |
| 70 | A |
| 60 | A |
| 50 | A |
| 40 | B |
| 30 | B |
| 20 | C |
| 10 | C |

Also in the present embodiment, as in the embodiment 1, the image ratio can be within a range of 30%≦image ratio≦80% for providing a maximum effect and not causing other drawbacks.

As explained in the foregoing, it is rendered possible to prevent the image failure resulting from a deterioration in the secondary transfer efficiency, by detecting a new state of the intermediate transferring belt 5 and executing the <second mode> foregoing.

The embodiments 1 and 2 have been explained by a color image forming apparatus of rotary type provided with a rotary developing apparatus 4, but a similar effect can also be obtained by applying the cleaning simultaneous with transfer of the present embodiment to a color image forming apparatus of so-called in-line type utilizing plural developing means and plural image bearing members.

Also the embodiment 2 employs the print number stored in the non-volatile memory medium 21 as an index for detecting the new state of the intermediate transferring belt 5, but such example is not restrictive and there may also be employed any other index indicating the initial state of the intermediate transferring belt 5 such as a bias application time of the primary transfer roller 8.

Embodiment 3

In the embodiment 1, a predetermined operation is executed at the start of power supply in the main body of the image forming apparatus, while, in the embodiment 2, such predetermined operation is executed by detecting a new state of the intermediate transferring belt 5.

The present embodiment provides a configuration without the new belt detecting function explained in the embodiment 2. In case the new belt detecting function is absent, an effect similar to that in the embodiments 1 and 2 can be obtained by executing an image forming operation on the intermediate transferring belt 5, explained in the embodiment 1, by every predetermined number of image formations.

It is possible to provide an image forming apparatus capable of reducing the negative ghost by varying the interval of the aforementioned operations according to the performance of the image forming apparatus or, for example, in proportion to a print volume of the user.

The present inventors have identified it appropriate, in case of employing a color image forming apparatus of 4 ppm, to execute an operation of the <second mode> at every 500 pages, but such number is not restrictive since it may be varied according to various conditions such as a mode of mounting of an optional apparatus or a state of environment.

The present embodiment prevents drawbacks that may appear particularly when an image with a low image ratio is output frequently. For example, if a solid white image is output frequently, the image forming apparatus is operated often but the toner is scarcely deposited on the intermediate transferring belt 5. In the present embodiment, the intermediate transferring belt 5 is periodically coated with the toner even under such situation, so that the intermediate transferring belt 5 can be used with a stable surface state any time.

It is possible, by combining the present embodiment with the embodiment 1, to obtain a constantly stable surface state of the intermediate transferring belt 5 regardless of the state of use of the user.

In the foregoing embodiments 1, 2 and 3, the intermediate transferring member has been explained as an intermediate transferring member of belt shape, namely an intermediate transferring belt, but it is also possible to use an intermediate transferring member of drum shape or an intermediate transferring drum with similar effects.

The present invention, explained in the foregoing, secures a constantly stable transfer efficiency in an image forming apparatus, thereby realizing a satisfactory image output without image defect.

What is claimed is:

1. An image forming apparatus comprising:

an image bearing member;

an intermediate transferring member for receiving a transfer of a toner image from said image bearing member;

cleaning means which cleans the toner image on said intermediate transferring member, said apparatus having a first mode for transferring a toner image on said intermediate transferring member onto a transfer material, and a second mode for forming a toner image in an entire area capable of image formation on said intermediate transferring member and cleaning said toner image without transfer to the transfer material.

2. An image forming apparatus according to claim 1, wherein said cleaning means cleans the toner image electrically.

3. An image forming apparatus according to claim 1, wherein said cleaning means includes means for charging the toner image on said intermediate transferring member in an inverse polarity, and means for executing electrical cleaning.

4. An image forming apparatus according to claim 1, wherein said cleaning means forms an electrical field between said intermediate transferring member and said image bearing member.

5. An image forming apparatus according to claim 1, further comprising memory means which stores a history of use of said intermediate transferring member, wherein the image forming apparatus executes said second mode based on information from said memory means.

6. An image forming apparatus according to claim 1, wherein the image forming apparatus executes said second mode prior to execution of said first mode in case said intermediate transferring member is unused.

7. An image forming apparatus according to claim 1, wherein the image forming apparatus, after a turn-on of a power supply thereof, executes said second mode prior to execution of said first mode.

* * * * *

UNITED STATES PATENT AND TRADEMARK OFFICE

CERTIFICATE OF CORRECTION

PATENT NO. : 6,912,369 B2
DATED : June 28, 2005
INVENTOR(S) : Saito et al.

It is certified that error appears in the above-identified patent and that said Letters Patent is hereby corrected as shown below:

Column 9,
Line 3, “mode >” should read -- mode > as explained in the --.

Signed and Sealed this

Second Day of May, 2006

JON W. DUDAS
*Director of the United States Patent and Trademark Office*